United States Patent [19]

Cutler, Jr. et al.

[11] 4,019,194

[45] Apr. 19, 1977

[54] PHOTOGRAPHIC APPARATUS FOR PROCESSING LARGE FORMAT, SELF-DEVELOPING FILM UNIT

[75] Inventors: Norman W. Cutler, Jr., Braintree; Duncan C. Sorli, Chelmsford, both of Mass.

[73] Assignee: Polaroid Corporation, Cambridge, Mass.

[22] Filed: Dec. 8, 1975

[21] Appl. No.: 638,352

[52] U.S. Cl. ..... 354/312

[51] Int. Cl.[2] ..... G03D 9/02

[58] Field of Search ..... 206/84; 354/186, 187, 354/83–86, 88, 182, 203, 303, 307, 312, 315, 317, 318

[56] References Cited

UNITED STATES PATENTS

| | | | |
|---|---|---|---|
| 2,451,820 | 10/1948 | Garrett | 354/86 |
| 2,496,630 | 2/1950 | Land | 354/86 |
| 2,873,658 | 2/1959 | Land | 354/86 |
| 3,405,620 | 10/1968 | Friedman | 354/85 |
| 3,650,188 | 3/1972 | Whall | 354/187 |
| 3,804,625 | 4/1974 | Sorli | 354/312 |
| 3,854,812 | 12/1974 | Sorli | 354/312 |

*Primary Examiner*—Donald A. Griffin
*Attorney, Agent, or Firm*—John S. Vale

[57] ABSTRACT

A processor for extracting a large format self-developing film unit from a cassette, applying a compressive pressure along the length of the film unit to distribute a fluid processing composition between predetermined layers of the film unit, and providing a substantially light-free environment for the film unit for imbibition. The processor features an imbibition dark chamber formed by first and second dark chamber sections. The first section is in the processor housing and the second section pivots between an extended position where it forms an extension of the first section and a storage position wherein it is located in a recess in the processor housing in overlying relation to the first section.

22 Claims, 8 Drawing Figures

PHOTOGRAPHIC APPARATUS FOR PROCESSING LARGE FORMAT, SELF-DEVELOPING FILM UNIT

BACKGROUND OF THE INVENTION

1. Field of the Invention

The present invention relates to the field of photography and, more particularly, to a processor for processing large format film units of the self-developing type.

2. Description of the Prior Art

Large format (e.g. 8 ×10 or 10 ×12) self- developing film units are used in a variety of applications. For example, X-ray-type film units are employed in the industrial and medical fields to provide instant radiographs. Reflection print film units (black and white or color) are used mostly for industrial, advertising and portrait photography.

The film units are generally loaded into a light- tight cassette and are exposed in conventional view cameras or X-ray apparatus.

After exposure, the cassette is moved to a processor which extracts the film from the cassette and, by the application of compressive pressure, distributes a fluid processing composition between predetermined layers of the film unit to initiate a well known diffusion transfer process.

In their most common form, each film unit includes a photosensitive element comprising an opaque or translucent support sheet having one or more photosensitive layers thereon and an image-receiving element comprising an opaque or translucent support sheet having one or more image- receiving layers thereon and a rupturable container of fluid processing composition coupled to the leading end of the support sheet.

The two sheets may be coupled together at their respective leading ends by a leader such that the two elements may be extracted simultaneously from the cassette in super- position with the photosensitive and image-receiving layers in face-to-face relation.

The leader is generally fed between pressure- applying members in the processor, e.g., a pair of juxtaposed rollers, which serve to apply a compressive pressure progressively along the length of the film unit to rupture the container and distribute the fluid between the photo- sensitive and image-receiving layers as the film unit is advanced relative to the "pressure-applying" members.

After a suitable imbibition period, the two sheets may be separated to reveal a positive image on the image-receiving sheet.

In addition to processing the film units, the processor must provide a substantially light-free environment for the imbibition period because not all self-developing film units include a complete self-contained opacification system. For example, the X-ray film units have outer support sheets which are slightly translucent.

This function is usually provided by a film receiving dark chamber. Even if the film unit is self-opacifying (most reflection print types other than X-ray), the dark chamber light seals the light path between and around the rollers to prevent fogging of that part of the film unit between the cassette and the entry side of the rollers.

Considering the large size of the film units, cassetts, and view cameras or portable X-ray apparatus, it is highly desirable that the processor be portable, compact, and easy to carry, store and use.

Examples of previously know compact and portable larger format processing systems (processor, film units, and cassettes) may be found in U.S. Pat. Nos. 3,788,205; 3,802,887; 3,804,625; and 3,854,812. In these systems, compactness is achieved by storing the processed film unit for imbibition in a coiled or curved condition.

For example, in the first three patents, the film unit is warapped onto a cylindrical drum for fluid distribution and imbibition storage.

In the last patent, the film unit emerges from the exit side of a pair of rollers and is advanced into a semicircular dark chamber. Also, the cassette is supported on the outside of the processor housing to further enhance compactness and portability.

Other compact processors employ a linear film unit path of travel into a flat receiving chamber. For example, see U.S. Pat. No. 2,689,306 (FIGS. 13, 16, 17, and 18) wherein the cassette is supported such that a major portion of its length extends outside of the processor housing and the film unit is andvanced into a linear receiving chamber within the processor housing.

The use of auxiliary dark chambers (one that attaches to and extends beyond the main processor housing) for reducing the overall storage size of a processing system is also known in the prior art. See U.S. Pat. No. 2,638,828 wherein the auxiliary dark chamber is pivotally mounted (detachable) on the main processor housing in communication with a film exit slot. This patent suggests (Col. 3, lines 22 to 27) that the auxiliary chamber may be removed and stored within the main processor housing when the processor is not in use.

For other examples of processors with pivoting imbibition chambers, see U.S. Pat. Nos. 3,344,730 and 3,364,835. Examples of self-developing cameras having pivoting, expansible, or detachable imbibition chambers are found in U.S. pat. Nos. 2,451,820; 2,467,320; 3,369,469; and 3,650,188. Note should also be taken of U.S. Pat. No. 3,165,046 which discloses a portable document copier having a multifunction carrying handle thereon. The reason for this will become apparent later on in this disclosure.

Each of the noted prior art compact processors performs the intended film processing function in a satisfactory manner. However in certain applications there may be limitations to the particular construction employed.

For example, in some applications, such as aerial or portrait and advertising photography, one may not wish to use a processor in which the processed film unit is stored in a curved condition for imbibition because of the tendency to induce a slight and temporary curl in the photograph. Therefore one would choose, most likely, a processor having a linear dark chamber for storing the film unit in a flat condition.

If setup and dismantling time are important, one may not wish to choose a processor that has a dark chamber which must be detached from its operative position for storage elsewhere.

SUMMARY OF THE INVENTION

The present invention provides a compact and easy to use large format self-developing film unit processor.

It features a linear type of dark chamber that is formed by a first dark chamber section located in the processor housing and a self-storing second section or dark chamber extension which when located in its operative position cooperates with the first section to provide means for receiving and storing a processed film unit in a light- free environment.

The processor housing has a film entry slot and cassette supporting structure on one side thereof. The cassette is supported at its leading end in cantilever fashion. This construction is similar, in some respects, to the cassette supporting structure shown in the previously noted U.S. Pat. No. 3,854,812.

A pair of processor rollers are located within the housing with the film entry side thereof facing the film entry slot. Preferably, the rollers are motor driven.

On the film exit side of the rollers is the first dark chamber section. It is hollow and it preferably extends to the opposite side of the housing and is dimensioned to receive and support approximately 40% of the given total length of the film unit.

The second dark chamber section is also hollow but is closed at one end. It is pivotally mounted on the housing near the far end of the first section (furtherest from the rollers) for pivotal movement between operative and storage positions.

When in the operative position, the second section is located in alignment and communication with the first section. It extends outwardly beyond the processor housing and is preferably dimensioned to receive and support approximately 60% of the total given length of the processed film unit. A pivoting access door for film removal is provided in the second section along with appropriate light seals for the door and the connection between the first and second sections.

To store the dark chamber extension, the second section is pivoted towards the processor housing into substantially parallel overlying relation with the first dark chamber section and the processing rollers. A recess is provided in the top of the housing for receiving the dark chamber extension.

This type of construction has several advantages. It allows for flat film storage during imbibition and yet the dark chamber does not have to be physically removed for storage. It is merely folded into the storage position.

Unlike the full length pivoting imbibition chambers disclosed in some of the previously note patents, this dark chamber folds (preferably at the 40/60 ratio of total chamber length) and the stored extension is substantially flush with the ends of the opposite end walls of processor housing.

This effect is aesthetically pleasing and is more in line with contemporary styling than the previously noted processors.

The system is also enhanced by a unique multi function latch for the second dark chamber section which also supports the film access door in a convenient open configuration when the chamber is operative.

A processor carrying handle is built into the cassette supporting structure which also adds to the convenience and contemporary styling of the processor embodying the present invention.

Therefore, it is an object to this invention to provide a compact and easy to use processor for large format self-developing film units that is uniquely configured and lends itself to contemporary styling.

It is another object to provide a processor which features a two section dark chamber that allows the processed film unit to be stored in a flat condition for imbibition in a substantially light-free environment.

Another object is to provide such a dark chamber having first and second sections arranged such that the second section may be moved between a storage position wherein it is located in overlying relation to the first section and in operative position wherein it is in alignment and communication with the first section and forms an extension thereof.

Yet another object is to provide such a two section dark chamber wherein each of the two sections are dimensioned to be less than the total given length of a self-developing film unit, but the combined total length of the two sections (when located in the operative configuration) is sufficient to form a dark chamber for receiving the entire processed film unit.

Other objects of the invention will in part be obvious and will in part appear hereinafter.

BRIEF DESCRIPTION OF THE DRAWINGS

For a fuller understanding of the nature and objects of the invention, reference should be had to the following detailed description taken in connection with the accompanying drawings wherein.

DESCRIPTION OF THE PREFERRED EMBODIMENT

Figure 2:
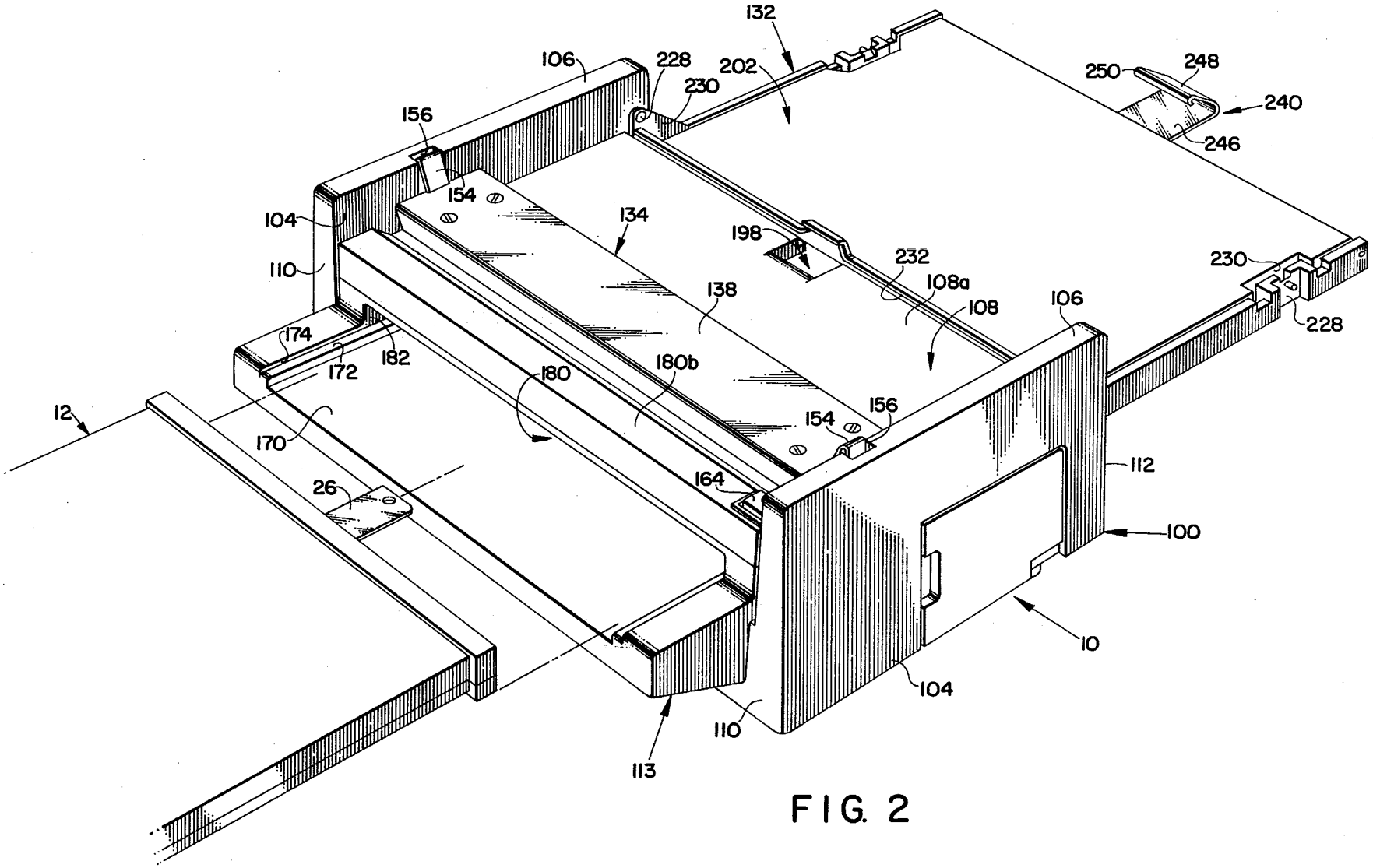
FIG. 2 is a persepctive view of the processor in FIG. 1 in its operative configuration and the leading end of a cassette, holding a large format self-developing film, unit about to be inserted into the cassette receiving and supporting section on the processor housing.
Figure 3:
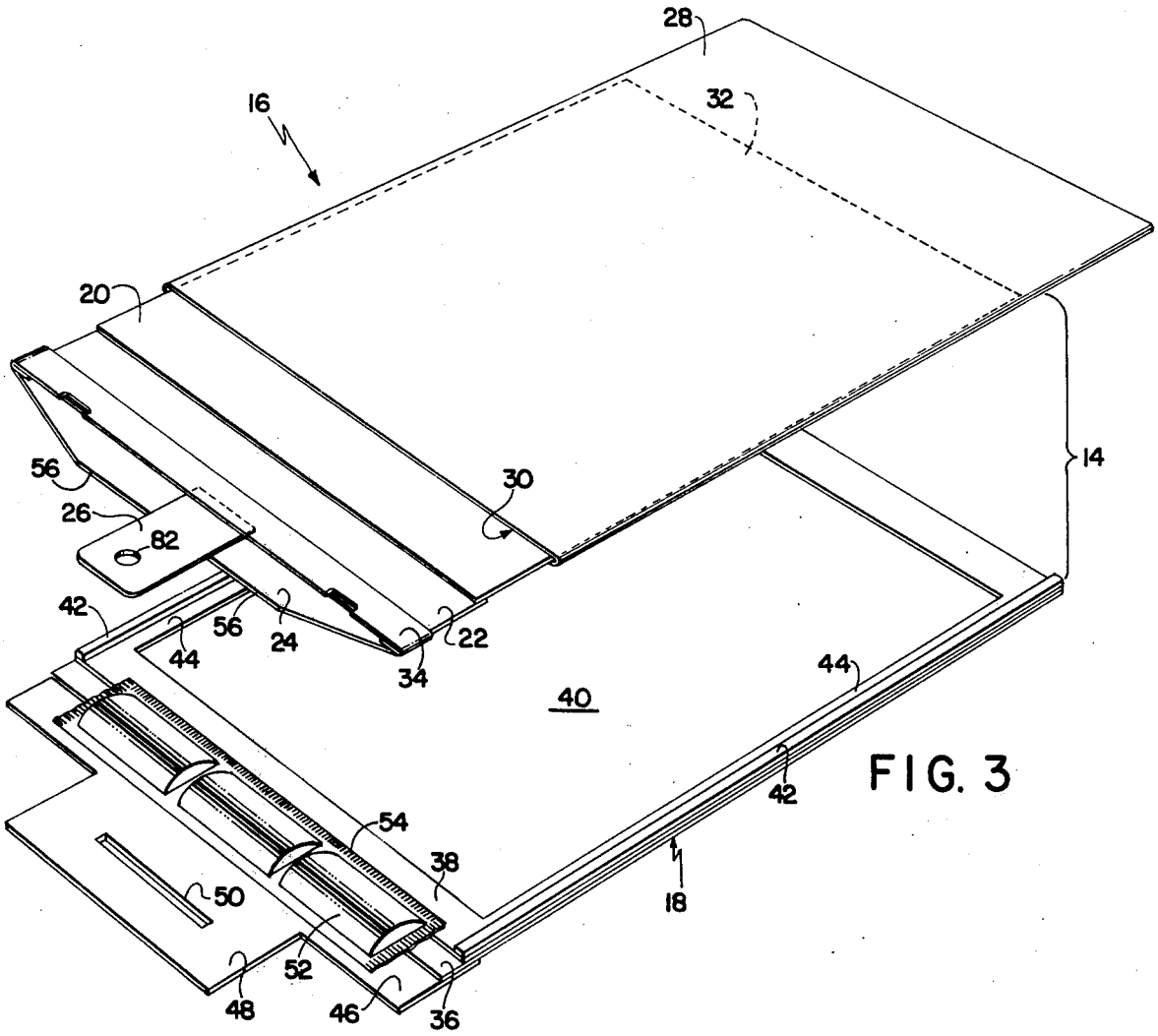
FIG. 3 is a perspective view of a large format, self-developing film unit which is especially well suited to be processed in the processor shown in FIGS. 1 and 2.
Figure 4:
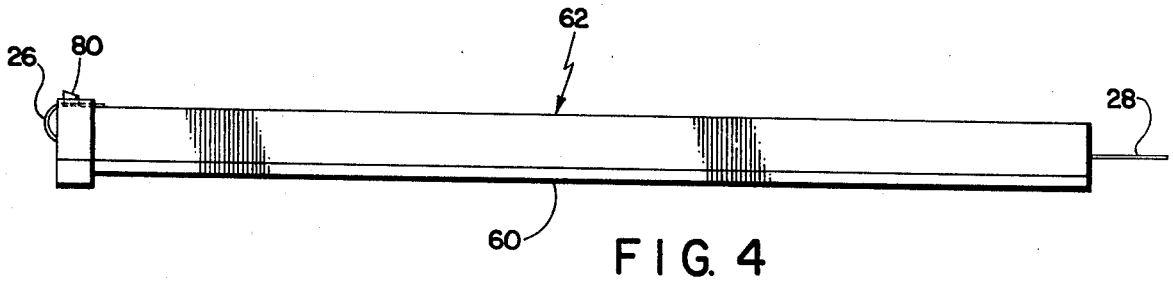
FIG. 4 is an elevational view of the film holding cassette that is adapted for use with the processor of FIGS. 1 and 2.

The components forming a unique system for processing a large format self-developing film unit are shown in FIGS. 2, 3, and 4 of the drawings. They include a film unit processor 10, a film holding cassette 12, and a self- developing film unit 14.

A detailed view of film unit 14 is shown in FIG. 3 of the drawings. In its preferred form, it comprises a first film element 16, commonly referred to as the photosensitive element or negative sheet, and a second element 18 which may be called an image-receiving element or positive sheet.

The photosensitive element 16 includes a generally rectangular support sheet 20 having one or more photosensitive layers coated on one side thereof. Sheet 20 is preferably formed of a conventional paper or plastic film base material which may be opaque or slightly translucent. Attached across the leading end of sheet 20 is a paper or plastic leader 22 for facilitating manipulation of sheet 18 during cassette loading and subsequent processing operations. Leader 22 is preferably configured to include a tapered portion 24 (for stiffening the leading end of the film element 14) which terminates in a generally rectangular, centrally disposed, and forwardly extending tab 26, the functions of which will be described hereinafter.

In order to protect the photosensitive layer on sheet 20 from exposure to visible light before film element 16 is loaded in holding cassette 12, element 16 is preferably provided with a removable opaque paper or plastic envelope 28. Envelope 28 is sealed along three edges and includes an opening 30 along the fourth edge through which the trailing end 32 of sheet 20 may be inserted. The opening 30 is light sealed by an opaque overskirt 34 on leader 22 into which the leading end of the envelope 28 is adapted to be inserted. Once film element 14 is loaded into a lighttight cassette 12, envelope 28 may be withdrawn from the trailing end 32 of sheet 20.

The second film unit element 18 preferably comprises a generally rectangular, opaque (or slightly translucent), paper or plastic support sheet 36 having one or more image-receiving layers coated on one side thereof. A strippable rectangular mask 38 is releasably secured around the marginal edges of the coated surface and serves to define the bounds of a generally rectangular, central image-forming area 40. In a preferred embodiment, a pair of slightly raised spacers or rails 42 are provided on the lateral margins 44 of mask 38 for establishing a predetermined gap between the photosensitive and image- receiving layers, when sheets 20 and 36 are superposed, to control the thickness of the layer of processing fluid distributed therebetween.

Attached to, and extending across the leading end of sheet 36, is a paper or plastic leader 46 which terminates in a forwardly extending, centrally disposed, sheet manipulation tab 48 having a centrally and laterally disposed elongated slot 50 therein.

In this embodiment, film element 18 also includes a rupturable container 52 holding a fluid processing composition. Container 52 is preferably formed of a rectangular blank of vapor and liquid impermeable material which is folded over on itself and sealed along three edges to form a cavity for holding the processing fluid. The container is secured to leader 46 such that a relatively weak longitudinal seal 54 faces the image forming area 40 of sheet 36.

As will be described in detail hereinafter, the photosensitive element 16 is loaded into cassette 12 after which the opaque envelope 28 is removed from sheet 20. The cassette is then mounted on a view camera or X-ray apparatus and the photosensitive layer or emulsion is exposed to form a latent image therein. The image-receiving element 18 is then inserted into the cassette 12 in overlying relation to element 16 such that the photosensitive and image-receiving layers are in face-to- face relation.

The leading ends of elements 16 and 18 are coupled together by folding tab 48 back on itself such that slot 50 is at the leading edge of the folded tab 48. The tab 26, on film element 16, is then inserted through slot 50 until the planar forward edge 56 of leader portion 24 abuts against the crease in the folded tab 48 on either side of slot 50.

Tab 26 is fed into processor 10 where pressure applying members (to be described later) frictionally engage tab 26 and draw the two superposed elements 16 and 18 from cassette 12 and into the processor 10.

The pressure applying members compress the walls of the container 52 and induce a hydraulic pressure in the fluid which causes the longitudinal seal 54 to rupture thereby dispensing the fluid in a mass along the leading edge of the image forming area 40.

As the superposed elements 16 and 18 are progressively advanced between the pressure applying members, the mass of liquid is advanced along a wave front which travels from the leading to the trailing end of the image forming area 40. Accordingly, the fluid is distributed between and in contact with the photosensitive and image-receiving layers to initiate the well known diffusion transfer process. As noted earlier, the side rails or spacers 42 on mask 38 serve to regulate the thickness of the fluid layer between sheets 20 and 36. In a preferred embodiment, the trailing end margin 57 of mask 38 is provided with a liquid trap (not shown) for collecting any excess fluid which may extend beyond the trailing end of the image forming area 40.

Once the fluid has been distributed, the user begins to time a predetermined imbibition period, typically 15 seconds for black and white film and one minute for color, after which the photosensitive and image-receiving elements may be separated to view the positive image on sheet 36.

At this point, it may be well to point out that the chemical composition of film unit 14 has been described in somewhat general terms and that it may be configured to produce either black and white or full color positive images. For a more detailed description of the chemical composition of suitable photosensitive and image-receiving layers and compatible processing fluids, reference may be had to U.S. Pat. No. 2,983,606, issued to H. G. Rogers on May 9, 1961, and U.S. Pat. Nos. 2,698,236, 2,698,237 and 2,698,245, issued to E. H. Land on Dec. 28, 1954.

Figure 7:
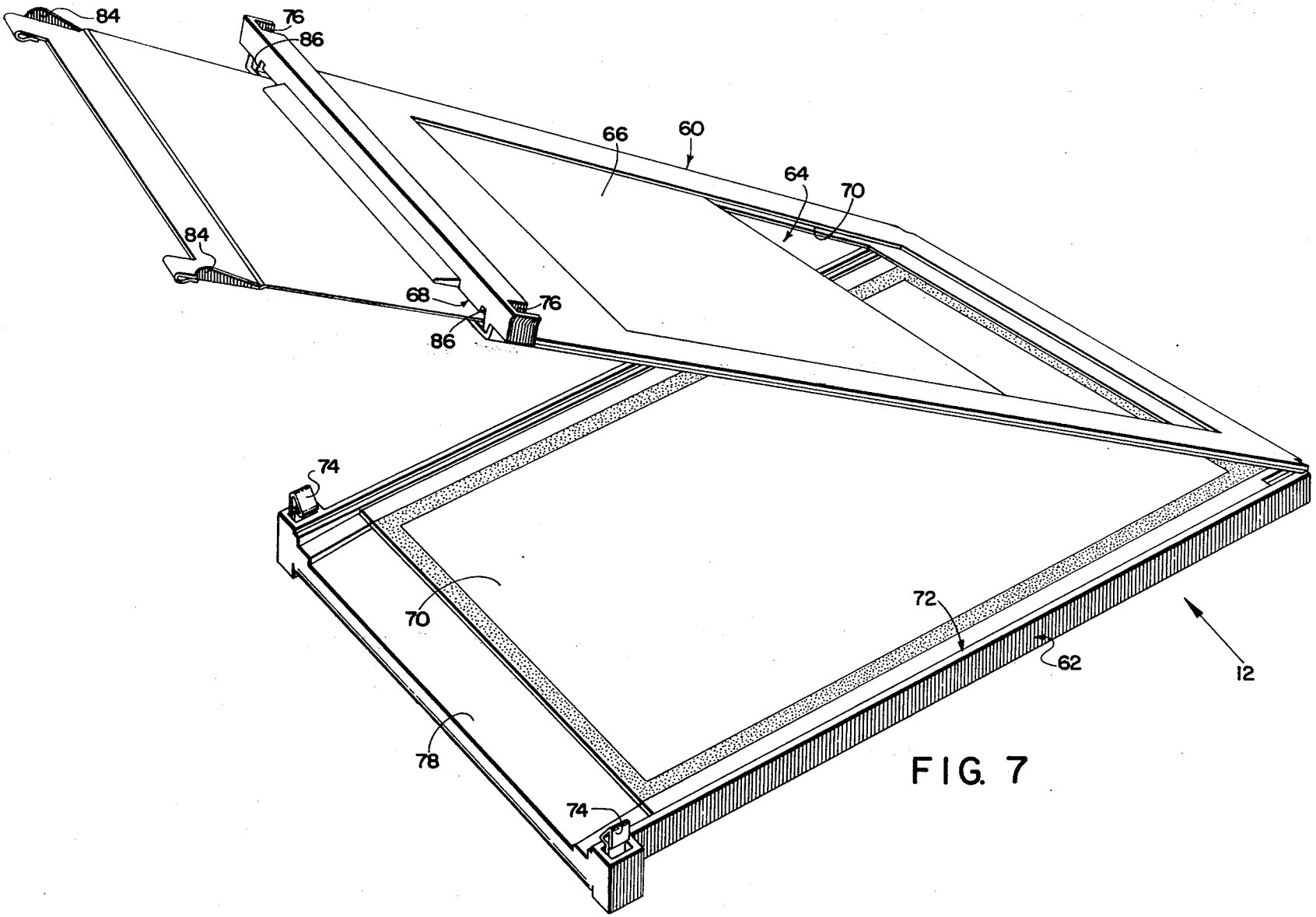
FIG. 7 is a perspective view of the film holding cassette of FIG. 4 in its open configuration.

The film holding cassette 12 which is especially well suited for use with processor 10 and film unit 14 is best shown in FIGS. 4 and 7.

The cassette is formed by two generally rectangular plate-like members 60 and 62 which are hinged together near the lateral corners of their respective trailing ends for movement between the open or film loading position of FIG. 7 and the closed position of FIG. 4 wherein members 60 and 62 cooperate to form a lighttight enclosure for film element 16.

Cassette member 60 is formed of any suitable opaque material, i.e., metal or plastic, and is configured as a rectangular frame which defines a rectangular exposure aperture 64 therein. The exposure aperture 64 is adapted to be blocked and unblocked by means of a plate-like dark slide 66 which is adapted to be inserted into member 60 through an elongated opening 68 at its leading end. Communicating with opening 68 is a pair of guide slots 70 disposed along the lateral edges of exposure aperture 64 for guiding the edges of dark slide 66 as it slides between its blocking and unblocking position.

Cassette member 62 includes a generally planar bottom wall 70 having a pair of upstanding flanges 72 along its lateral edges. It will be noted cassette member 60 is configured to be thicker in the center (to accommodate dark slide 66) than out at its lateral edges. This thicker center portion extends down between flanges 72 when the cassette is closed such that lateral edges rest on top of flanges 72 to create a labyrinth-type of light seal therebetween.

In order to releasably secure the cassette members 60 and 62 in the closed position, member 62 is provided with a pair of spring biased latching members 74 near its leading end which are adapted to engage appropriate detents 76 formed in the leading end of cassette member 60.

The film element 16 is placed on the bottom wall 70 of cassette member 62 with its envelope enclosed photosensitive coated side facing the exposure aperture 64 and its leading end tab 26 extending beyond the leading end of member 62.

It will be noted that the bottom wall 70 includes a generally rectangular depression 78 at its leading end to accommodate the relatively thick envelope sealing overskirt 34.

The cassette is then closed and latched. The forwardly extending film tab 26 is folded around the leading end of member 62 and is releasably coupled to the underside of bottom wall 70 by a projection 80 integrally formed therewith which is adapted to extend through a hole 82 in tab 26 (See FIG. 4).

The opening at the leading end of the cassette 12, between member 60 and 62, may be light sealed by a strip of resilient material (for example, foam rubber) secured across the leading end of the underside of member 60. With the leading end of film unit 16 secured to the cassette, the opaque envelope 28 may be withdrawn from sheet 20 through a light baffled opening (not shown) at the trailing end of the cassette between the hinges connecting members 60 and 62.

Cassette 12 then may be mounted on a camera or X-ray apparatus to expose the photosensitive emulsion through exposure aperture 64. One skilled in the art will appreciate that in the case of X-ray applications, the dark slide 66 will be made of a suitable material which is transparent to X-rays such that it may remain in its blocking position during exposure.

It will be noted that dark slide 66 is provided with a pair of upturned flanges 84 near its leading end lateral edges which are adapted to slide into a pair of slots 86 in the leading end of cassette member 60 when the dark slide 66 is in its fully inserted or blocking position. The function of flanges 84 are to engage and pivot upwardly a resilient light sealing member (not shown) which normally depends from the upper edge of the elongated opening 68 towards the bottom edge thereof.

Subsequent to the exposure of film element 16, and with the light seal retracted by flanges 84, the second film element 18 may be inserted through opening 68, on top of dark slide 66, with its image-receiving layer facing downwardly towards the photosensitive layer of film element 16 on the opposite side of dark slide 66.

With both elements 16 and 18 held in the closed cassette 12, tab 48 is folded and tab 26 on element 16 is removed from its engagement with projection 80 and is inserted through the slot 50 in folded tab 48 on film element 18 to couple the leading ends of the elements together as described earlier.

Accordingly, the film elements 16 and 18 may be extracted from cassette 12 simultaneously and thereby brought into face-to-face contact by pulling tab 26 outwardly from the leading end of the cassette.

Figure 1:
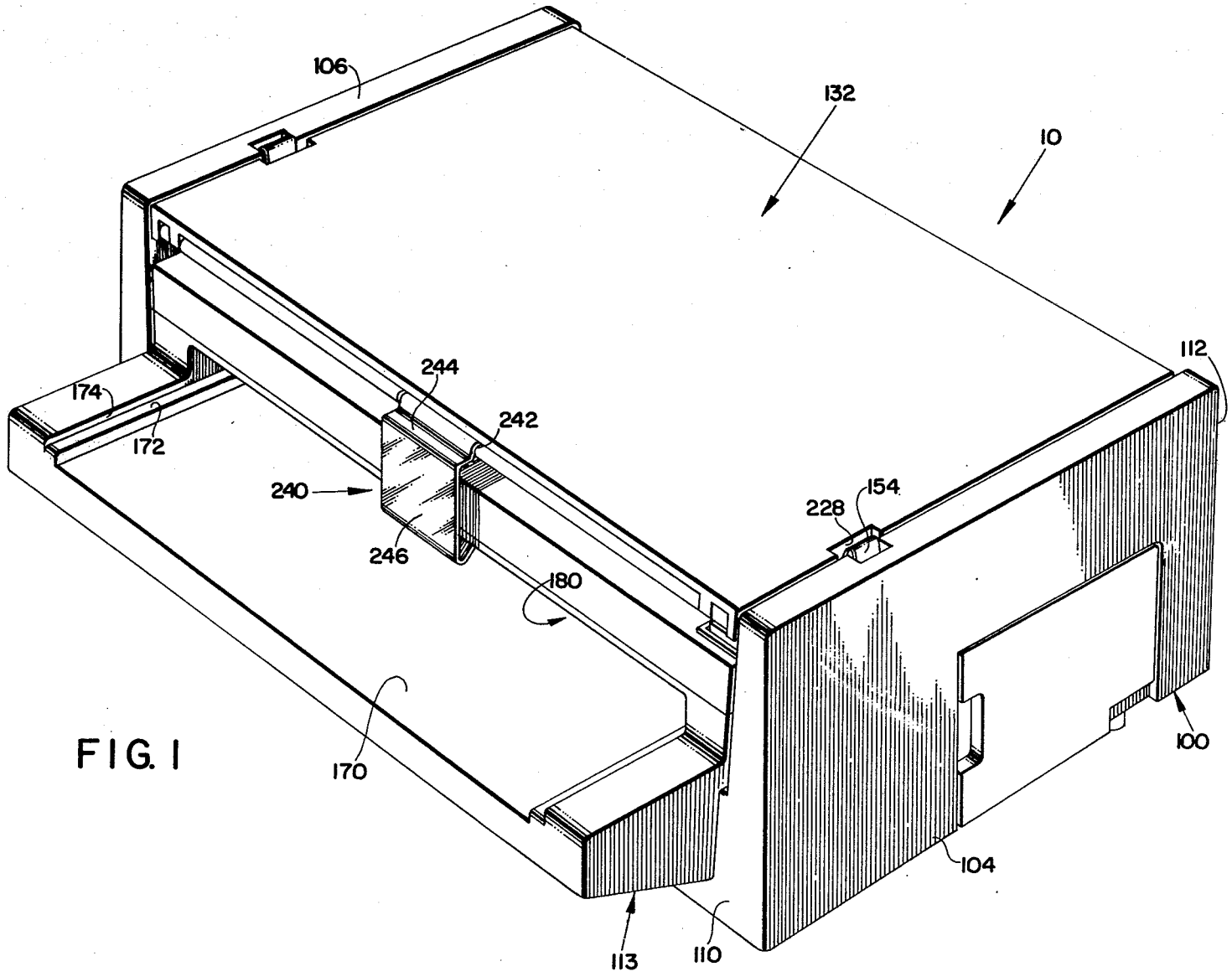
FIG. 1 is a perspective view of large format self-developing film unit processor, embodying the instant invention, shown in its storage configuration.
Figure 5:
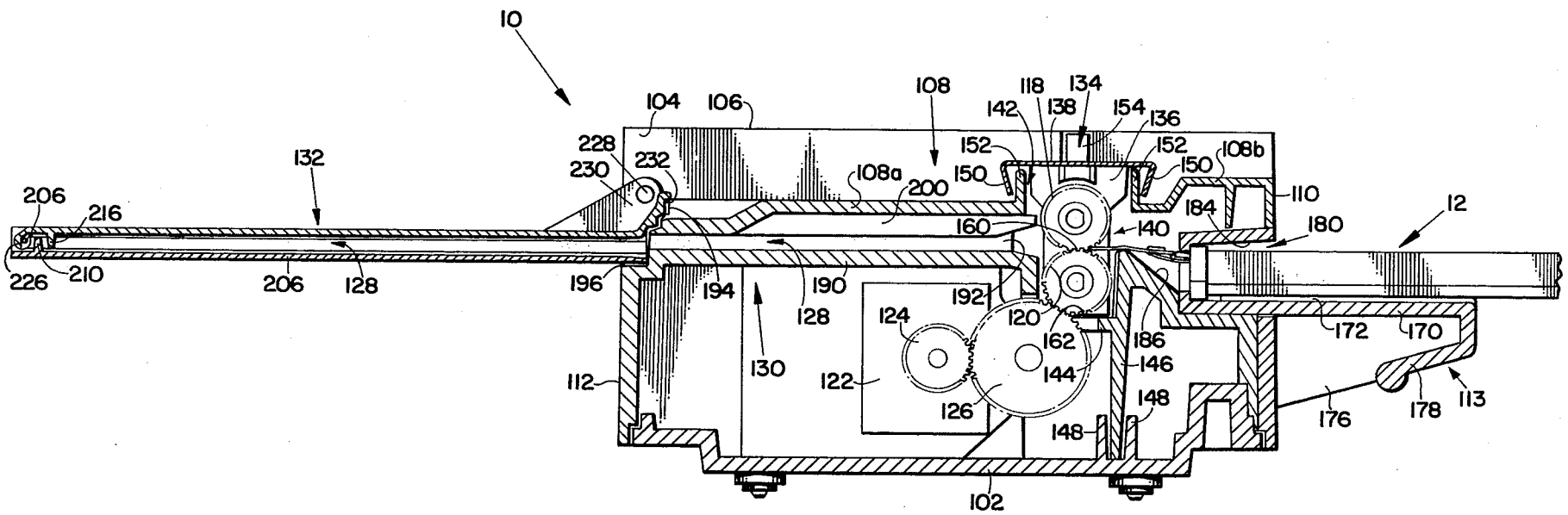
FIG. 5 is a side elevational, view partly in section, of the processor shown in FIG. 2 with the cassette located at its operative position and the film manipulation tab of the film unit inserted into the bite between the pair of pressure-applying and film-advancing rollers.
Figure 6:
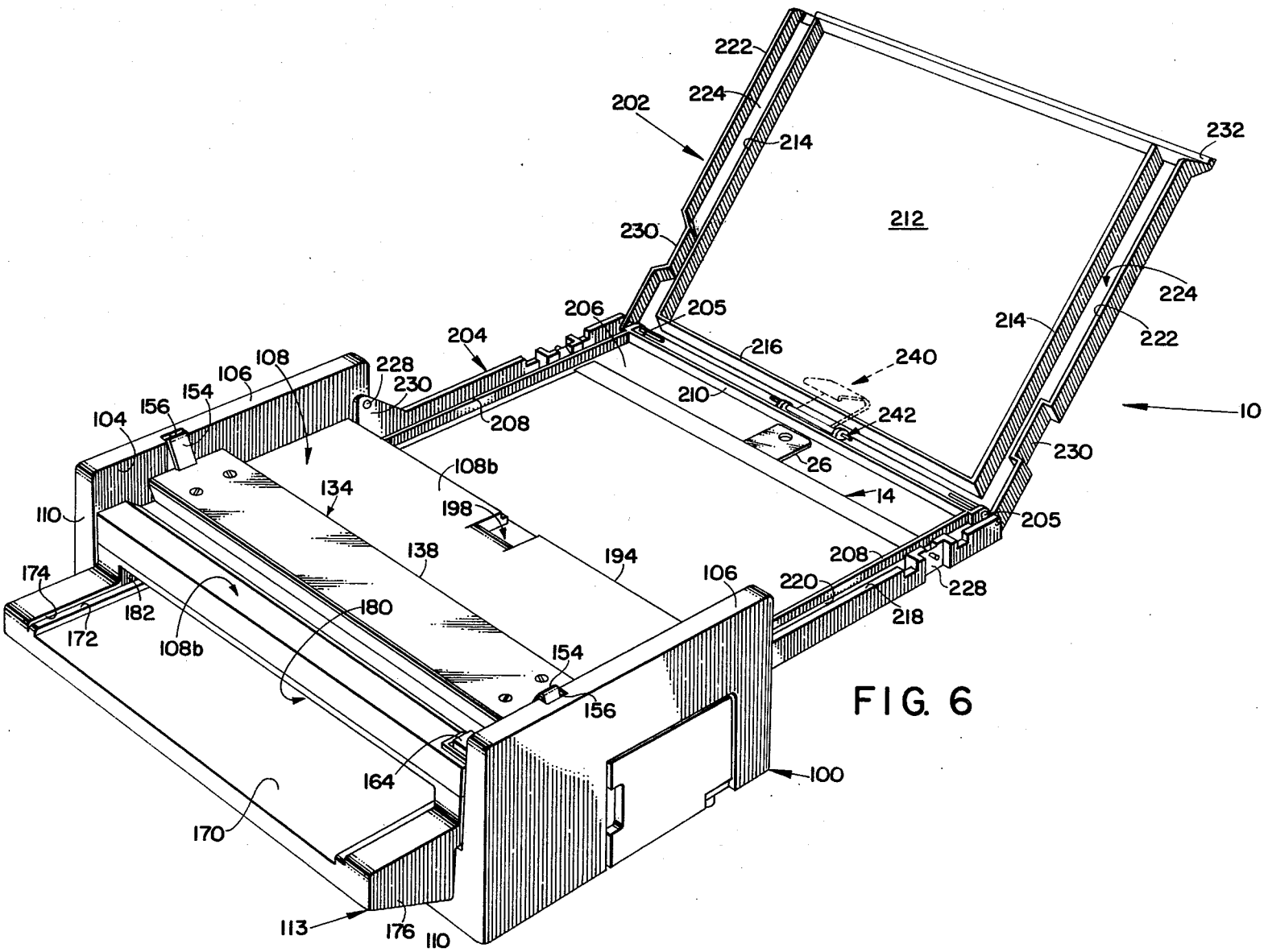
FIG. 6 is a perspective view of the processor of FIG. 2 showing the film access door, in the dark chamber extension, located in an open position and a processed film unit in the dark chamber.
Figure 8:
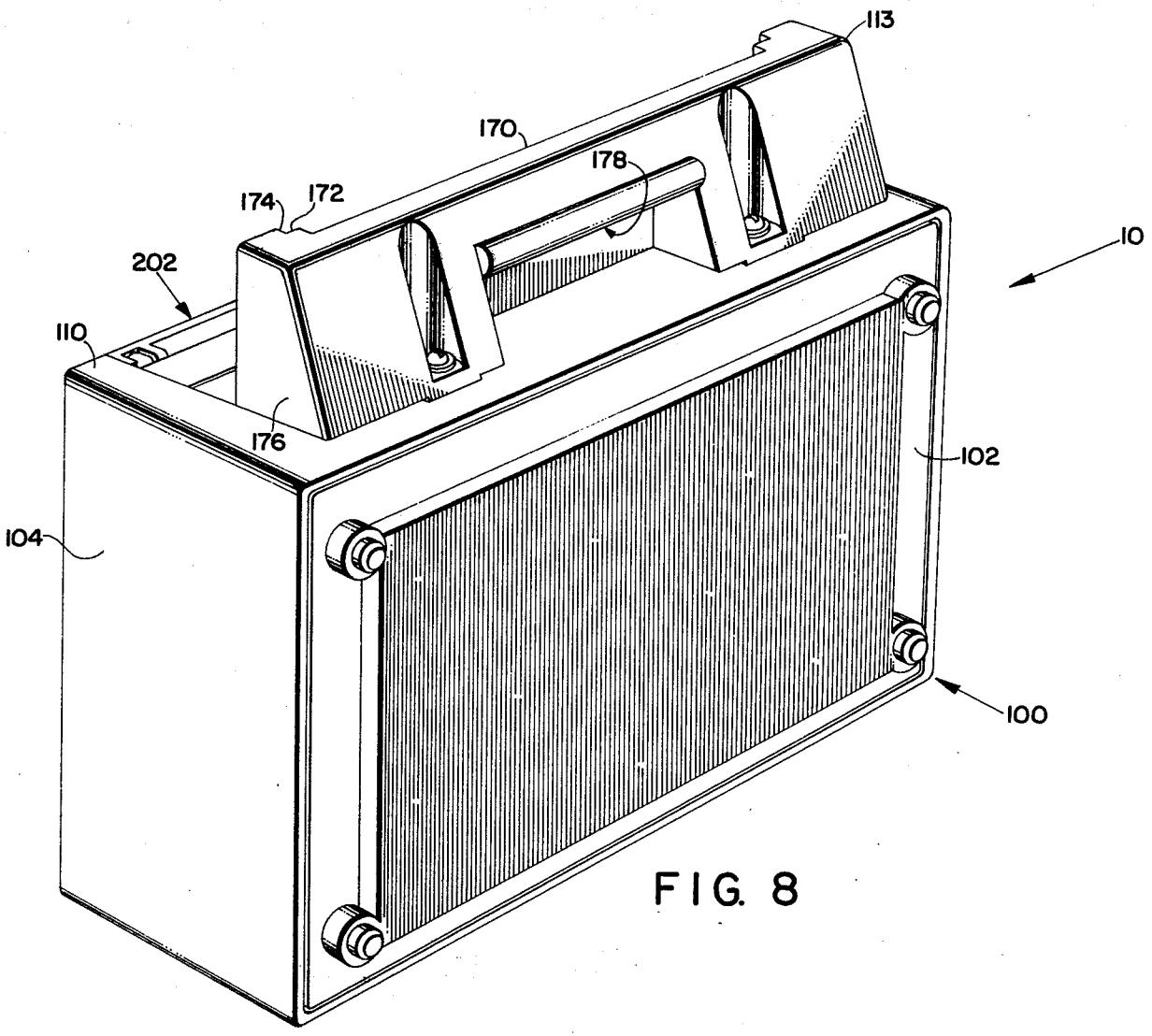
FIG. 8 is a perspective view of the processor of FIG. 1 showing the details of a carrying handle integrally formed with the underside of the cassette supporting member.

The processor 10 is shown in FIGS. 1 and 8 in a carrying and/or storage configuration and in its operative configuration in FIGS. 2, 5, and 6.

It includes a box-like housing 100, which may be formed of any suitable light opaque materials, for example, sheet metal, plastic or combinations thereof.

Housing 100 is formed by a bottom wall section 102; a pair of lateral side wall sections 104, having top wall portions 106 integrally formed therewith; a central substantially horizontal recessed section 108 intermediate side walls 104, being lower than the top wall portions 106; a leading end wall section 110; and an opposed trailing end wall section 112.

Mounted on leading end wall 110, and partially extending into housing 100, is a cassette receiving and supporting member 113 which supports the leading end of cassette 12 in cantilever fashion, to position the film manipulation tab 26 in alignment with a film entry slot 114 formed in an interiormost vertical wall 116 of cassette support member 113.

In substantial alignment with entry slot 114 is the entry side bite line of a pair of juxtaposed rotatably mounted pressure-applying rollers 118 and 120. In a preferred embodiment the rollers are rotatably driven by an electrical motor 122 coupled to the rollers by means of a suitable speed reduction gear train formed by gears 124 and 126.

In alignment with the exit side of the pressure roller bite line is a light excluding dark chamber 128 for receiving and supporting a film unit 14 that has been advanced between rollers 118 and 120, in a substantially light-free environment.

As best shown in FIG. 5, dark chamber 128 is formed by a first dark chamber section 130 located within the bounds of housing 100, and a second dark chamber section 132 which is coupled to housing section 100 for movement between the operative position of FIG. 5 where it is aligned with and forms an extension of section 130 to cooperate therewith and define chamber 128, and a storage and carrying position shown in FIG. 1 wherein section 132 is positioned over section 108 of housing 100 between side walls 104 in substantially parallel overlying relation to dark chamber section 130.

The rollers 118 and 120 are rotatably mounted on a bracket assembly 134 which is releasably secured to housing 100 so that the entire roller and bracket assembly may be easily removed to inspect and clean the rollers when necessary.

Specifically, rollers 118 and 120 are rotatably mounted between a pair of laterally spaced and vertically depending brackets 136 which are in turn coupled together by a horizontal cross member or bracket 138.

A laterally extending roller receiving chamber or depression 140 is formed within housing 100 and has an access opening 142 between the two sections (designated 108*a* and 108*b*) defining the central top recess or depression in housing 100 for receiving dark chamber extension 132. The roller assembly is supported at the bottom by a horizontal shelf 144 of a multipurpose internal support member 146 which is supported by bottom wall 102 and is captured between a pair of spaced, laterally extending upstanding ribs 148 preferably integrally formed with bottom wall 102.

As best shown in FIGS. 5 and 6, the bottom of the side brackets 136 sit on shelf 144 to support the roller assembly 134. Cross member 138 has a pair of down turned flanges 150 which straddle a pair of upturned ribs 152 (on sections 108*a and 108b*) bounding opening 142. Thus, cross member 138 and ribs 152 cooperate to form a labyrinth-type light seal for the roller receiving chamber 140. A pair of resilient latch member 154 are provided on brackets 136 and fit into vertical recesses 156 in side walls 104 for releasably securing the roller assembly to housing 100.

Rollers 118 and 120 are preferably formed of a suitable metal, e.g. stainless steel, and a are dimensioned such that their central film engaging portions measure approximately ¾to 1 inch in diameter.

The lower roller 120 is preferably mounted such that it has a fixed vertical position relative to brackets 136. The upper foller 118 preferably is movable (vertically) relative to lower roller 120 and is spring biased downwardly towards thereto. The movement is provided to vary the gap between the rollers, and also the compressive pressure applied to the film unit. For a more detailed description of the rollers, and gap and pressure control structure, reference may be had to the previously noted U.S. Pat. No. 3,854,812.

Rollers 118 and 120 are driven in a direction to cause the film unit 14 to be advanced therebetween from cassette 12, supported on support member 113, into the operatively extended dark chamber 128. In the illustrated embodiment, the top and bottom rollers 118 and 120 have enmeshed drive gears 160 and 162 respectively fixedly secured to the far ends thereof (as viewed in FIG. 5) and the lower gear 162 is enmeshed with gear 126 which is driven by gear 124 coupled to the shaft of motor 122. Motor 122 may be any suitable electrical motor providing adequate torque and power. Depending on where the processor will be used, motor 12 may be an A.C. or D.C. motor. A button-type switch 164 is provided on housing section **108*b*, adjacent the cassette support member 113, for selectively connecting motor 122 to a source of electrical energy for operating processor 10.**

One skilled in the art will recognize that the illustrated gear train is but one of may methods for transmitting power from the motor 122 to the rollers 118 and 120, and it is within the scope of the present invention to utilize other drive train components, such as drive chain system disclosed in the previously mentioned U.S. Pat. No. 3,854,812.

The cassette support member 113 may be configured as illustrated so as to be inserted (at least partially) as a single unit through an appropriate opening in leading end wall 110 of housing 100.

As best shown in FIGS. 2, 5, and 6, member 113 includes a substnatially flat, horizontally disposed tray-like section 170 which supports underside of the leading end of cassette 12. The underside lateral edges of cassette 12 actually rest on a pair of laterally spaced guide rails 172 which are bounded at their outer edges by vertical guide rails 174. Rails 172 serve as reference bearing surfaces to locate the cassette in a substantially horizontal plane at the correct vertical height with respect to the film entry slot 114 and the bite line of the pressure-applying rollers. The side guide rails 174 provide the proper lateral orientation for the cassette.

The tray 170 extends into housing 110 to the intersection with the upstanding vertical wall 116 having entry slot 114 therein. It also extends outwardly from end wall 110 and is supported in cantilever fashion by a pair of laterally spaced substantially triangular support members 176. Integrally formed with the under side of tray 170 is a down and under turned carrying handle section 178 which is best shown in FIG. 8.

The exterior facing surface of vertical wall 116 serves as a reference-bearing surface for the leading end of cassette 12 to provide longitudinal orientation for cassette 12 relative to processor 10. The leading end of the cassette 12 is inserted through an opening 180 in cassette support 113 bounded by tray 170, a pair of vertical side walls 182 and sloping top wall 184.

It will be noted that the leading end of cassette 12 is thicker and wider than the main body. To accommodate this extra thickness and width, the guide rails 172 and 174 stop short of the vertical wall 116 to provide an appropirately sized chamber in front of wall 116 to receive the larger leading end of cassette. To insert and remove the cassette, it must be tilted (aft end raised) with respect to tray 170 so that the larger leading end will fit through opening 180. To accommodate the tilted cassette, the top wall 184 is sloped so that opening 180 becomes progressively larger from wall 116 towards wall 110.

When the cassette is fully inserted and seated on tray 170, that portion to top wall 184 near wall 116 bears on the top surface of the leading end of cassette 12 and provides the downward force necessary to support the cassette 12 in cantilever fashion on support 113. In other words, it counter balances the weight of that portion of cassette 12 that extends outwardly beyond support member 113.

Before cassette 12 is inserted into processor 10, the positive film element 18 is loaded into the cassette and the tab 26 on the negative element is inserted through leader member 48 on element 18 as previously described.

Now tab 26 extends forwardly of the cassette. When the cassette is partially inserted in member 113, the forwardly extending tab 26 passes through entry slot 114. As the cassette is moved further into member 113, tab 26 is guided to the bite line of the rollers by an upwardly inclined surface or guide ramp 186 which extends from slot 114 to the bite line in the path of travel of tab 26.

When cassette 12 is in the fully inserted position, the leading edge of tab 26 is wedged into the bit line of the rollers. The tab 26 is intentionally made a little longer than the distance from the leading end of the cassette to the bite line so that it takes on a slight S shape and acts as a forwardly biased spring to ensure positive frictional engagement with the rollers 118 and 120.

Although not shown in the drawings, support member 113 is provided with light sealing structure which light seals any light leak paths around the leading end of cassette 12 and through entry slot 114. Also, a detent latching system may be provided on cassette 12 and support member 113 to ensure that the cassette is releasably secured in its proper forwardmost position in member 113 so that the leading end of the cassette is held firmly against the vertical bearing surface of wall 116 around slot 114.

In response to energizing motor 122 (depressing button switch 164) the rollers 118 and 120 rotate in a direction to cause the engaged film unit 14 (by tab 26) in the cassette to be advanced from the cassette, between the pressure- applying rollers 118 and 120 and into dark chamber 128.

Although not shown in the drawing, appropriate edge control and spread control devices are built into processor 10 along the path of travel of film unit 14 from the leading end of the cassette 12 to the pressure-applying rollers 118 and 120. For typical examples of such control devices, along with a more detailed description of the pressure profiles applied to the film unit 14 during its advancement through rollers 118 and 120, reference may be had to the previously noted U.S. Pat. Nos. 3,854,812; 3,788,205; 3,802,887; and 3,804,625.

As noted eariler, dark chamber 128 is defined by a fixed dark chamber section 130, located within the confines of housing 100 on the exit side of rollers 118 and 120, and the second dark chamber section 132 which is configured for movement between the operative position of FIGS. 2, 5, and 6 wherein it extends outwardly beyond the boundaries of the housing 100 and communicates with section 130 to form an extension thereof and in cooperation therewith defines chamber 128, and a storage and/or carrying position (see FIGS. 1 and 8) wherein it is stored within the general boundaries of housing 100.

The lower boundary of the first dark chamber section 130 is defined by an interior wall section 190 disposed, within housing 100, in a generally horizontal plane just slightly below the bite line of the pressure-applying rollers 118 and 120 on the exit side thereof. Wall section 190 extends forwardly from the exit side of the rollers to the trailing end wall 112 of housing 100 and extends laterally between and to the interior surfaces of housing side walls 104.

The upper boundary of section 130 is defined the wall section or housing section **108*a* on the exit side of the rollers. Section 108*a* extends between and to side walls 104, and its center section is supported by depending, laterally spaced, side walls 192 which rest on the lateral edges of wall section 190 adjacent walls 104. In this manner, the under side of the central portion of section 108*a* is raised above the top horizontal surface of wall section 190 to define therebetween a hollow passageway for the film unit 14** on the exit side of the rollers.

Next to the exit side of rollers 118 and 120, section **108*a* includes one of the previously noted upstanding ribs 152 that cooperates with one of the flanges 150 on cross member 138 to form a light seal for the rollers receiving chamber 140. From rib 152, section 108*a* extends forwardly, in a substantially horizontal plane, to a leading end just short of processor housing end wall 112, where dark chamber section 130 meets the second dark chamber section 132**.

It will be noted that the leading end of section **108*a* is configured to include a series of laterally extending, and vertically ascending steps 194 that cooperate with complementary structure on dark chamber section 132 to light seal the boundary between these two sections when section 132 is located in the extended operative position. A laterally extending step 196 is also provided, at the leading end of wall section 190**, for this same purpose.

A centrally located shallow depression 198, extending rearwardly a short distance from the top step 194, is formed in section **108*a* to provide access for gripping a film unit unloading door on section 132** to be described hereinafter.

The underside of the central section of section **108*a* is preferably defined by a series of longitudinally disposed and laterally spaced depending vertical ribs 200, although this section could be of solid construction. The ribs' construction makes section 108*a* considerably lighter and are easily formed if section 108*a* is of molded plastic construction. It will be noted that the ends of the ribs 200 near the exit side of the rollers 118 and 120, and the portion of wall section 190 directly below are tapered or sloped to provide a guideway for the film unit 14 into chamber 128**.

In a preferred embodiment, section **108*a* is not fixedly attached to housing 100 and is releasably supported on the top surface of wall 190 by its depending side supports 192. The position is fixed by capturing rib 152 behind flange 150 on cross member 138. Thus roller assembly 134 must be unlatched and removed before section 108*a*** can be removed from its operative position.

The second dark chamber section 132 has many structural similarities to the book-opening type of cassette shown in FIGS. 4 and 7.

As best shown in FIGS. 5 and 6 it is a box-like, hollow, light opaque structure that is open at its leading end to align with the far open end of chamber section 130 thus defining the dark chamber 128.

It includes a generally square or rectangular top and bottom sections 202 and 204 which are pivotally coupled together at their respective distal ends (pivot points 205) for movement between the closed position of FIGS. 2 and 5 wherein sections 202 and 204 are in superposed relation, and the open position of FIG. 6 wherein sections 202 and 204 are pivoted apart to provide access to the interior of dark chamber section 130 for the purpose of removing a processed film unit 14 from dark chamber 128.

In a preferred embodiment, sections 202 and 204 are of molded, light opaque, plastic construction having major substantially planar square or rectangular top or bottom wall section and integrally molded peripheral wall sections (on three sides) which interleaf when section 130 is closed to form labyrinth-type light seals around the edges of the closed section 132.

The bottom section 204 inlcudes a bottom wall 206 having an upstanding inner rib structure (defined by side ribs 208 and a connecting end cross rib 210) around three sides thereof. The top section or access door 202 includes a top wall 212 having a complementary inner depending rib structure (defined by side ribs 214 and end cross rib 216) around three sides thereof that is adapted to fit inside of the inner rib structure on section 204 in nesting or telescoping relation when door 202 is closed. These cooperating inner ribs serve to form one of two sets of light seals for the three sides of dark chamber section 132.

The other set is formed by an arrangement of outer ribs on sections 202 and 204. The outer ribs on section 204 includes side ribs 218, spaced from inner side ribs 208 to define a pair of side channels 220 therebetween. Section 202 includes outer side ribs 220 that are spaced from inner ribs 214 to define channels 224 therebetween, and a cross end rib 226 (See FIG. 5). The outer side ribs 218 on section 204 and outer side ribs 222 on section 202 have complementary inset portions 228 and 230 which provided clearance for the roller assembly latches 154 when dark chamber section 132 is located in its storage and carrying position.

When the door section 202 is closed rib 210 on section 204 is positioned between cross end ribs 216 and 226 on section 202. The interleafed side rib sequence, reading from the interior to the exterior, is side ribs 214, 208, 222, and 218. Thus the cooperating ribs form a double labyrinth-type light seal around three sides of dark chamber section 132.

Chamber section 132 is pivotally mounted on housing 100 by means of pivot pins 228 which pass through triangular mounting bracket portions 230 integrally formed with the leading ends of the outer ribs 218 on chamber section 204 and into side walls 104. When chamber section 132 is in the operative position (see FIG. 5) the leading end of the bottom wall 206 sits on the right angle step 196 on wall 190 which acts as a support and locating surfaces for the extended chamber section 132 and also, in cooperation with the leading end of wall 206, forms a light seal for the bottom of the boundary or intersection between chamber sections 130 and 132. The sides of the intersection are light sealed by side walls 104 and the top is light sealed by an upturned, laterally extending step structure 232, integrally formed at the leading end the top wall 212 which complements and fits into the step structure 194 on section 108*a*. That portion of step structure 232 that is in front of the recess 198 in section 108*a* serves as a handle for grasping and lifting the door 202 on dark chamber section 132.

The interior dimensions of chamber 128 are, of course, determined by the size of the film units that are to be processed processor 10. Let's assume that the illustrated film unit 14 is 10 ×12 inches and that the leader and lab structure adds another 2 inches onto the length making the total given length of the film unit 14 inches. Therefore, chamber 128 must be just a little wider than 10 inches and just a little longer than 14 inches to accommodate a process film unit 14.

Because chamber 128 is formed by the two sections 130 and 132, each of the two sections is individually shorter than the total given length but when sections 130 and 132 are in operative alignment they form a chamber that will accommodate the film unit.

To provide a processor that is compact when in the storage configuration, the split was made between chamber sections so that section 132 will fold over into the recess 108 between side walls 104 and fit into the general boundaries of housing 100. More specifically, the processor is configured (as best shown in FIG. 1) so that section 132 (when stored) is substantially flush with the exterior surfaces of housing end walls 110 and 112 and top walls 106. This self-storing feature not only makes for a very compact processor, but it also enhances the contemporary styling of the unit.

In the illustrated embodiment, the ratio of chamber section length is approximately 40% of the total film length in chamber section 130 and approximately 60% of the total film length in chamber section 132. Thus for a film unit 14 having a given total length of 14 inches, the interior passageway in section 130 measures a little more than approximately 5.6 inches and the interior passageway in section 132 measures a little more than 8.4 inches.

Exteriorly dark chamber section is dimensioned so that it fits snugly between side walls 104 and is substantially flush with end walls 110 and 112 and top wall 106 when it is in the folded position of FIG. 1

The folded over dark chamber section 132 is held in its storage position in the top recess 108 of housing 100 by a multifunction latch member 240.

Latch 240 is a resilient or spring-like device that is pivotally mounted on the interior end surface of 206 at pin 242. From the pivot point (as viewed in FIG. 1) it has a formed right angle step 244, a depending flat section 246 and an under turned section 248 which terminates in a further under turned rolled surface 250. When shown in the carrying or storage positions of FIGS. 1 and 8, the rolled section 250 frictionally engages the underside of the structure forming cassette opening 180 (top wall 184) to releasably hold the folded dark chamber section 132 in place.

When dark chamber section 132 is extended, the step 244 engages the trailing end and edge of wall 206 such that section 246 extends outwardly from the trailing or closed end of chamber section 132 in a horizontal plane thereby positioning rolled edge 250 above the closed door 202. When door 202 is opened, it engages and rests against rolled edge 250 (see FIG. 6) so that latch 240 also serves as a means for maintaining door 202 in a convenient open position to facilitage the removal of a processed film unit from chamber 128.

It will be noted that latch 240 is not shown in FIG. 5 of the drawings because of space limitations.

FIG. 8 shows the processor 10 in a carrying configuration wherein its trailing end wall 112 is at the bottom. The handle 178 is positioned along a weight considered centerline for balance. This centerline may or may not coincide with the geometrical centerline of wall 110 depending on the weight distribution of the components (such as the rollers 118 and 120 and motor 122) forming processor 10.

In operation, dark chamber section 132 is unlatched and pivoted to the operative position of FIGS. 2 and 5. The motor 122 is coupled to a source of energy and a cassette 12, holding a film unit 14 (an exposed element 16 and positive element 18), is inserted into support member 112. The motor 122 is energized by actuating switch 164 causing the film unit to be advanced from cassette 12, through rollers 118 and 120 and into the dark chamber 128 defined by sections 130 and 132 where it is stored in a flat condition for imbibition. After a suitable imbibition period (from 10 seconds to a minute depending on the type of film used) door 202 is opened and rests against the extended latch 240 (see FIG. 6) to remove the processed film unit. The positive and negative elements then may be stripped apart to view the positive image.

Although the second dark chamber section 132 is illustrated and described as being pivotally mounted, it is within the scope of this invention to provide other means and methods for moving a self-storing dark chamber extension between the operative and storage position. For example, with suitable guide tracks or channels on the interior of side walls 104, dark chamber section 132 could be modified for sliding movement similar to that of an offset drawer.

While the instant processing system has been directed to processing a film unit comprising separate photosensitive and image-receiving elements which are adapted to be superposed after exposure of the photosensitive element, it will be understood that the processor 10 and cassette 12 may be used for processing other types of film units.

For example, U.S. Pat. No. 3,415,644 issued to E. H. Land on Dec. 10, 1968, describes a film unit having a photosensitive element and an integral, transparent, image-receiving element through which the photosensitive element may be exposed. Utilizing this type of film structure would eliminate the need for the interlocking tab construction and it may be used by simply providing a single pull tab at the leading end of the film unit.

Since certain changes may be made in the above apparatus and system without departing from the scope of the invention herein involved, it is intended that all matter contained in the above description or shown in the accompanying drawings shall be interpreted as illustrative and not in a limiting sense.

What is claimed is:

1. A processor for receiving and supporting a light-tight cassette holding a self-developing film unit of a given total length and for advancing the film unit from the cassette, distributing a fluid processing composition within the film unit and providing a light-free enviornment for the film unit, the film unit being of the type having a plurality of layers including photosensitive and image- receiving layers, a rupturable container holding a fluid processing composition adapted to be distributed between a predetermined pair of such layers, and a film unit manipulation tab extending forwardly of a leading end of the film unit, the cassette being of the type included a light sealed opening at one end thereof through which the tab may protrude and also through which the film unit may be withdrawn from the cassette by pulling on the tab, said processor comprising:

a housing having a film entry slot therein through which such a film unit may be advanced in said housing;

means on said housing for receiving and supporting such a cassette holding a film unit such that the opening at one end of the cassette faces and is in alignment with said film entry slot;

processing means, including a pair of rotatably mounted pressure-applying rollers located within said housing with a film entry side of said rollers adjacent said film entry slot for engaging a film unit manipulation tab, extending through said film entry slot, and for advancing the film unit from the cassette, into said housing, and between said pair of rollers to an exit side thereof and for progressively applying a compressive pressure along the length of the film unit to distribute the fluid processing composition between the predetermined pair of layers of the film unit, said processing means also including means for rotatably driving at least one of said pair of rollers in a direction to cause the film unit to be advanced therebetween from the entry side of the rollers to the exit side thereof;

means defining a dark chamber on said exit side of said rollers for receiving and supporting a film unit in a substantially light-free environment, said dark chamber defining means including first and second dark chamber sections, each being of a length that is less than the given total length of such a film unit, said first section being located on said housing and having a film entry opening at one end thereof located in alignment with the path of travel of a film unit emerging from the exit side of said rollers, said second section being coupled to said housing for movement, without being uncoupled from said housing, between an operative position wherein at least a major portion of said second section extends outwardly beyond said housing and said second section is in alignment and communication with an opposite open end of said first section to form a dark chamber, in cooperation with said first section, of sufficient length to receive and support a film unit of such a given total length, and a storage position wherein said second section is located in superposed relation to at least said first section; and means providing access to said dark chamber, defined by said first and second sections located in said operative position, for removing a processed film unit therefrom.

2. A processor as defined in claim 1 wherein said second dark chamber section is coupled to said housing for pivotal movement between said operative and storage positions.

3. A processor as defined in claim 1 wherein said housing and said second dark chamber section are configured such that said second dark chamber section is located within the general boundaries of said housing when said second dark chamber section is in its said storage position.

4. A processor as defined in claim 3 wherein said housing includes means defining a recess therein for receiving said dark chamber section when located in its said storage position.

5. A processor as defined in claim 4 wherein said recess is located over said first dark chamber section and said pair of pressure-applying rollers.

6. A processor as defined in claim 3 wherein said housing includes opposed end walls, laterally spaced side walls and laterally spaced top walls and said second dark chamber section is configured to have surfaces that are substantially flush with said side walls, end walls, and top walls when said second dark chamber section is located in said storage position.

7. A processor as defined in claim 6 further including means for releasably latching said second dark chamber section in storage position.

8. A processor as defined in claim 7 wherein said latching means is coupled to said second dark chamber section and includes means for engaging at least a portion of said means for supporting a cassette for releasably latching said second section in said storage postion.

9. A processor as defined in claim 1 wherein said cassette supporting means is configured to support such a cassette in cantilever fashion such that a major portion of the cassette extends outwardly from said housing.

10. A processor as defined in claim 1 wherein said second dark chamber section is pivotally coupled to said housing and said second dark chamber section, when located in said storage postition, is located in substantially parallel overlying relation to said first dark chamber section.

11. A processor as defined in claim 10 wherein said second dark chamber section also is located in overlying relation to said pressure-applying rollers when located in said storage postion.

12. A processor as defined claim 1 wherein said first and second dark chamber sections cooperate to form a substantially linear chamber for receiving and supporting a processed film unit in a flat condition.

13. A processor as defined in claim 12 wherein said first dark chamber section is configured to receive and support that portion of the film unit representing approximately 40% of its given total length and said second section is configured to receive and support that portion of the film unit representing approximately 60% of its given total length.

14. A processor as defined in claim 13 wherein said second dark chamber section is coupled to said housing for privotal movement between said operative and storage positions.

15. A processor as defined in claim 1 wherein said access means includes an access door on said second dark chamber section.

16. A processor as defined in claim 15 wherein said access door is mounted on said second dark chamber section for pivotal movement between open and closed positions and said second dark chamber section is coupled to said housing fork pivotal movement between said storage and operative positons.

17. A processor as defined in claim 15 further including a multifunction member which serves to latch said second dark chamber section in its said storage position to said housing and also serves to support said access door in a conveinent open position to facilitate the removal of a processed film unit when said second dark chamber section is located in said operative position.

18. A processor as defined in claim 1 further including means for light sealing the junction of said first and second dark chamber sections located in said operative position.

19. A processor as defined in claim 18 wherein said first dark chamber section is configured to include a plurality of step-like members at said junction and said second section includes complementary structure that is adapted to cooperate with said step-like member so form at least a portion of said light seal.

20. A processor as defined in claim 1 wherein said housing includes means defining a recess for receiving said second dark chamber section in its said storage position and further includes means defining a chamber depending from said recess for housing said pair of rollers.

21. A processor as defined in claim 20 wherein said pair of rollers are mounted on a bracket assembly so as to be easily inserted into and removed from said roller-receiving chamber.

22. A processor as defined in claim 1 further including a processor carrying handle integrally formed with said means for receiving and supporting a cassette.

* * * * *